US007026552B2

(12) United States Patent
Sokol et al.

(10) Patent No.: US 7,026,552 B2
(45) Date of Patent: Apr. 11, 2006

(54) MULTI-TAP COMPRESSION CONNECTOR

(75) Inventors: Robert L. Sokol, Orland Park, IL (US); Robert W. Kossak, Lemont, IL (US); Brian Keller, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 11/005,988

(22) Filed: Dec. 7, 2004
(Under 37 CFR 1.47)

(65) Prior Publication Data

US 2005/0139374 A1 Jun. 30, 2005

Related U.S. Application Data

(63) Continuation of application No. 10/669,391, filed on Sep. 24, 2003, now Pat. No. 6,846,989.

(60) Provisional application No. 60/467,031, filed on Apr. 30, 2003, provisional application No. 60/413,686, filed on Sep. 26, 2002.

(51) Int. Cl.
*H01R 4/00* (2006.01)

(52) U.S. Cl. ..... 174/84 C; 174/94 R

(58) Field of Classification Search ..... 174/84 R, 174/84 C, 74 R, 71 R, 94 R; 439/98, 877, 439/882
See application file for complete search history.

(56) References Cited

U.S. PATENT DOCUMENTS

| | | | | |
|---|---|---|---|---|
| 2,938,069 | A | 5/1960 | Toedtman et al. | |
| 2,956,108 | A | 10/1960 | Brenner | |
| 2,964,585 | A | 12/1960 | Nilsson et al. | |
| 3,009,987 | A | 11/1961 | Brenner | |
| 3,322,888 | A * | 5/1967 | Zemels | 174/94 R |
| 3,340,352 | A | 9/1967 | Teagno et al. | |
| 3,354,517 | A * | 11/1967 | Levinsky | 403/275 |
| 3,746,777 | A | 7/1973 | Peek | |
| 4,350,843 | A | 9/1982 | Campbell et al. | |
| 5,036,164 | A * | 7/1991 | Schrader et al. | 174/94 R |
| 5,103,068 | A * | 4/1992 | Schrader | 174/94 R |
| 5,200,576 | A | 4/1993 | Schrader et al. | |
| 5,635,676 | A | 6/1997 | Piriz | |
| 6,261,137 | B1 | 7/2001 | Wilcox | |
| 6,452,103 | B1 * | 9/2002 | Piriz et al. | 174/84 C |
| 6,486,403 | B1 | 11/2002 | Connor | |
| 6,525,270 | B1 | 2/2003 | Connor et al. | |
| 6,538,204 | B1 | 3/2003 | Connor | |
| 6,552,271 | B1 | 4/2003 | Connor et al. | |

FOREIGN PATENT DOCUMENTS

| | | |
|---|---|---|
| DE | 1277975 | 9/1968 |
| EP | 468378 A1 | 1/1992 |

OTHER PUBLICATIONS

FCI Framatome Group, Burndy Products Catalog, p. C-103, date unknown.

* cited by examiner

*Primary Examiner*—William H. Mayo, III
(74) *Attorney, Agent, or Firm*—Robert A. McCann; Christopher S. Clancy

(57) ABSTRACT

A compression connector for securing wires therein is disclosed. The compression connector has a first section connected to a second section. Each of the first and second sections has a body portion and an end wall. The body portion has a hook and a ramp extending therefrom to form a main wire port, and the body portion has first and second tap wire ports adjacent the end wall. An angled collapsible link is defined between the first and second tap wire ports.

6 Claims, 6 Drawing Sheets

MULTI-TAP COMPRESSION CONNECTOR

CROSS-REFERENCE TO RELATED APPLICATIONS

This application is a continuation of application Ser. No. 10/669,391, filed Sep. 24, 2003, now U.S. Pat. No. 6,846,989, which claims priority to U.S. Provisional Application Ser. Nos. 60/413,686, filed on Sep. 26, 2002, and 60/467,031, filed on Apr. 30, 2003, the entireties of which are hereby incorporated by reference.

BACKGROUND OF THE INVENTION

The present invention is directed to a multi-tap compression connector, and more particularly, to a split multi-tap compression connector that can accommodate different size tap wires.

Examples of multi-tap compression connectors can be found in the following U.S. Pat. Nos. 3,009,987; 5,103,068; 5,200,576; 6,452,103; 6,486,403; 6,525,270; 6,538,204; and 6,552,271. However, none of these prior art compression connectors have a first collapsible link positioned between the first and second tap wire ports, and a second collapsible link positioned between the third and fourth tap wire ports. Moreover, none of these prior art compression connectors have a first angled crumple zone positioned between the first and second side tap wire ports, and a second angled crumple zone positioned between the third and fourth side tap wire ports.

SUMMARY OF THE INVENTION

It would be desirable to provide a multi-tap compression connector having increased wire pullout strength.

It would also be desirable to provide a multi-tap compression connector having improved retention of tap wires before and during the crimping operation.

It would further be desirable to provide a multi-tap compression connector having a collapsible link to increase the overall compressibility of the compression connector.

It would also be desirable to provide a multi-tap compression connector having non-coplanar side taps to improve retention of tap wires therein.

A compression connector for securing wires therein is disclosed. The compression connector has a first section connected to a second section. Each of the first and second sections has a body portion and an end wall. The body portion has a hook and a ramp extending therefrom to form a main wire port, and the body portion has first and second tap wire ports adjacent the end wall. An angled collapsible link is defined between the first and second tap wire ports.

Preferably, the compression connector has a first pair of slots extending between the first section and the second section on a first side thereof, and a second pair of slots extending between the first section and the second section on a second side thereof. The first and second pairs of slots are capable of receiving a cable tie for securing wires therein before crimping.

Preferably, each of the first, second, third and fourth tap wire ports are teardrop-shaped and are substantially the same size. Alternatively, the first tap wire port may be larger than the second tap wire port, and the third tap wire port may be larger than the fourth tap wire port.

Preferably, the compression connector has first, second, third and fourth retention tabs. The retention tabs retain the tap wires in the tap wire ports.

In another preferred embodiment, a compression connector for securing wires therein is disclosed. The compression connector has a first body portion connected to a second body portion. Each of the body portions has a hook and a ramp extending therefrom to form a first main wire port, and a hook and a ramp extending therefrom to form a second main wire port. Each of the body portions further has two side tap wire ports, and an angled crumple zone defined between the two tap wire ports.

Preferably, the compression connector has a first pair of slots extending between the first and second body portions on a first side thereof, and a second pair of slots extending between the first and second body portions on a second side thereof. The first and second slots are capable of receiving a cable tie for securing wires therein before crimping.

Preferably, each of the side tap wire ports is positioned between a hook and a ramp. Moreover, each of the side tap wire ports are substantially the same size. Alternatively, each of the side tap wire ports are a different size.

DETAILED DESCRIPTION OF PREFERRED EMBODIMENTS

The illustrated embodiments of the invention are directed to a split multi-tap compression connector having at least one main line wire and two tap wires secured therein. FIGS. 1–6 are directed to a compression connector 20, FIGS. 7–12 are directed to a compression connector 120, and FIGS. 13–19 are directed to a compression connector 220.

Figure 1:
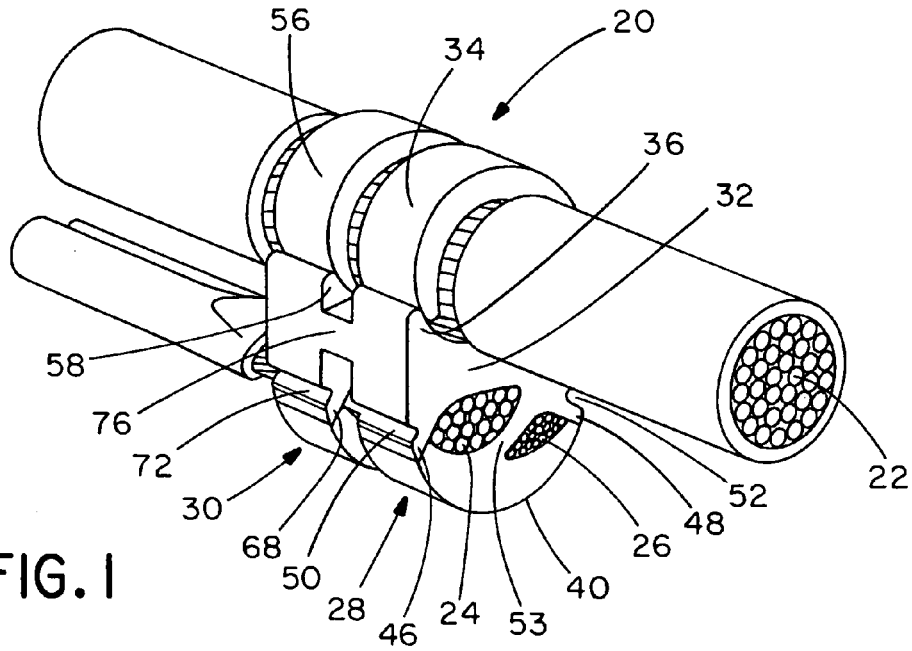
FIG. 1 is a front perspective view of a compression connector according to a first embodiment of the present invention, shown secured around main line wires after crimping one large tap wire and one small tap wire.

FIG. 1 shows a split multi-tap compression connector 20 secured around main line wires 22 and tap wires 24, 26, after crimping. Preferably, compression connector 20 is a one-piece member made of electrically conductive material, such as copper. However, it is likewise contemplated that compression connector 20 may be made of any suitable materials or elements that will withstand a crimping operation.

Figure 2:
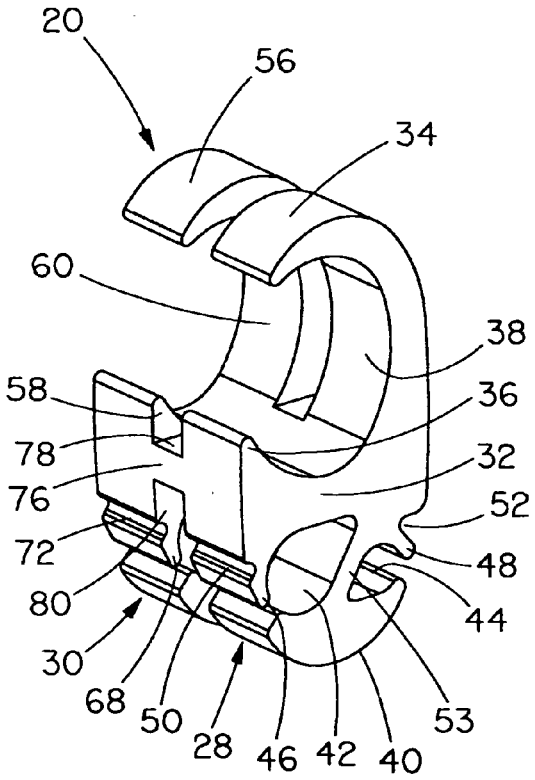
FIG. 2 is a front perspective view of the compression connector of FIG. 1.
Figure 3:
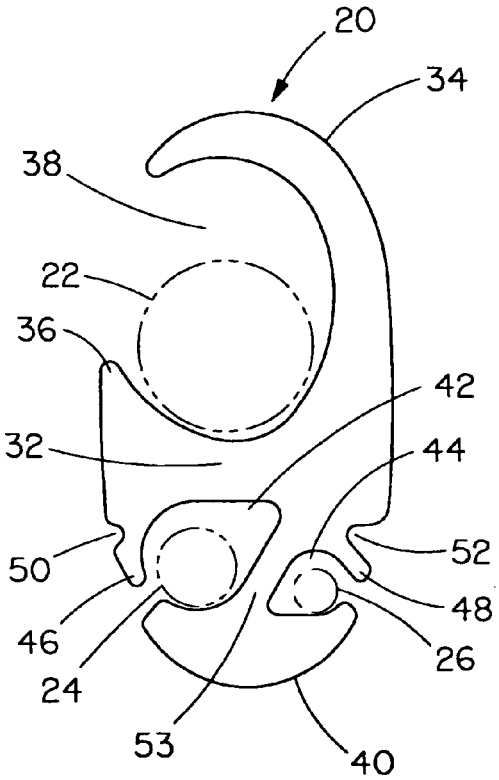
FIG. 3 is a front view of the compression connector of FIG. 1.
Figure 4:
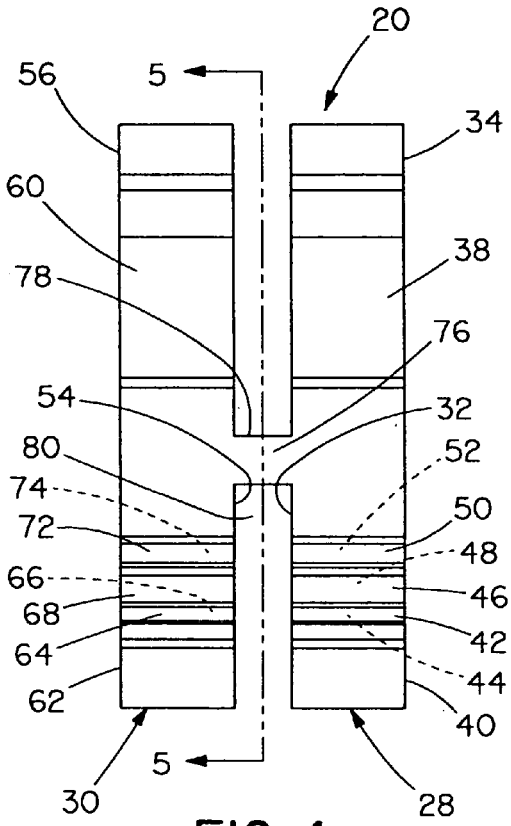
FIG. 4 is a left side view of the compression connector of FIG. 1.

As shown in FIGS. 2 and 4, compression connector 20 has a first section 28 and a second section 30. As best seen in FIG. 3, first section 28 includes a first body portion 32 having a hook 34 and a ramp 36 extending therefrom to form main wire port 38 in which main line wires 22 can be placed. Preferably, hook 34 is C-shaped. First section 28 has a first end wall 40 connected to first body portion 32. Tap wire ports 42, 44 are adjacent first end wall 40, and retention tabs 46, 48 extend from first body portion 32 at an oblique angle. Groove 50 is positioned between retention tab 46 and ramp 36, and groove 52 is positioned between retention tab 48 and hook 34. Collapsible link 53 connects first body portion 32 and first end wall 40, and is positioned between tap wire ports 42, 44.

Figure 6:
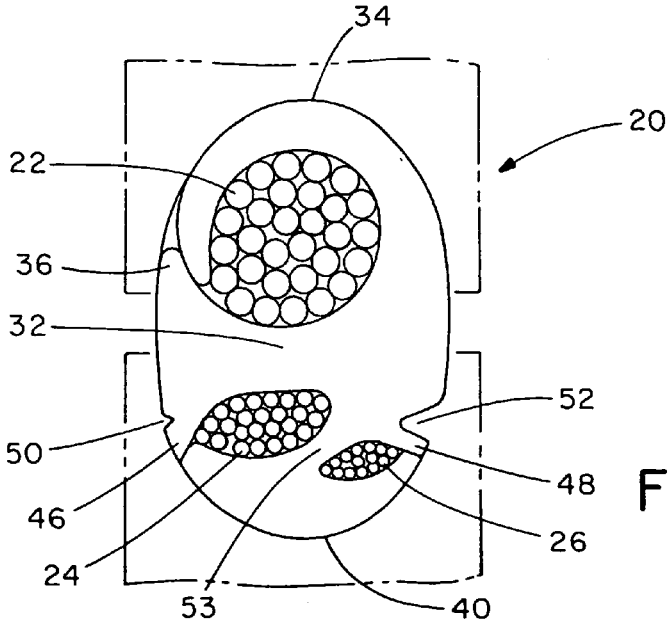
FIG. 6 is a front view of the compression connector of FIG. 1, after crimping one large tap wire and one small tap wire.
Figure 8:
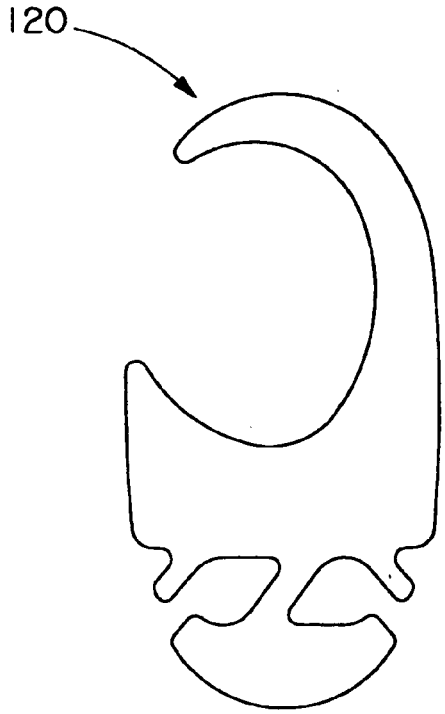
FIG. 8 is a front view of the compression connector of FIG. 7.
Figure 9:
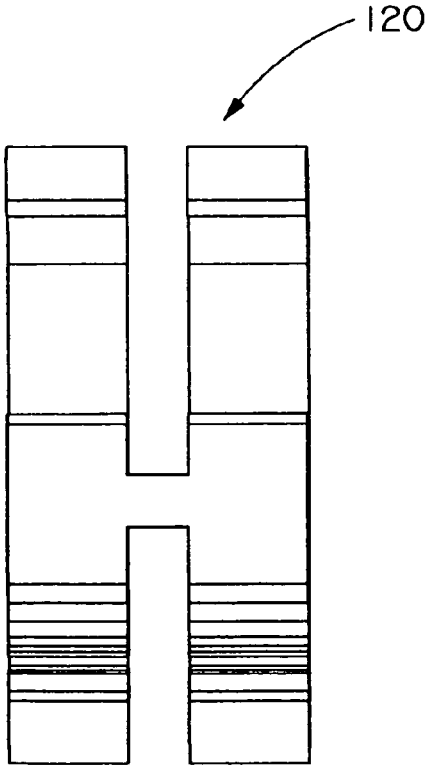
FIG. 9 is a left side view of the compression connector of FIG. 7.
Figure 10:
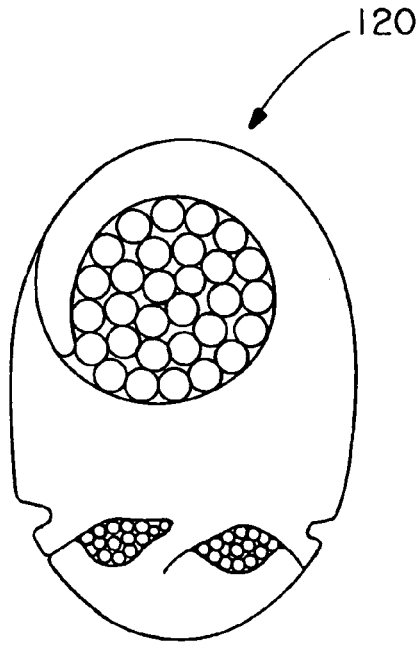
FIG. 10 is a front view of the compression connector of FIG. 7, after crimping two large tap wires.
Figure 11:
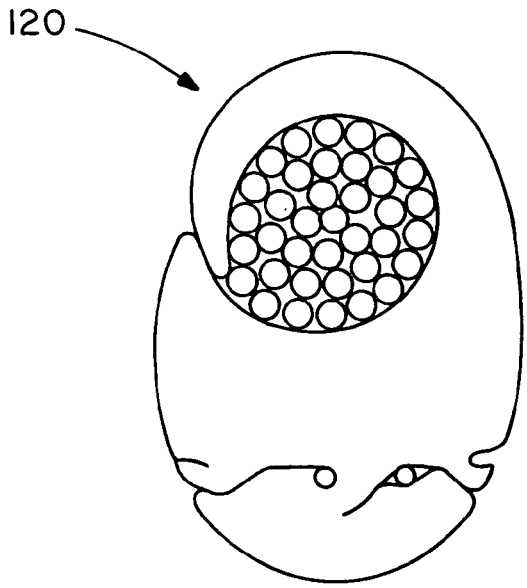
FIG. 11 is a front view of the compression connector of FIG. 7, after crimping two small tap wires.
Figure 12:
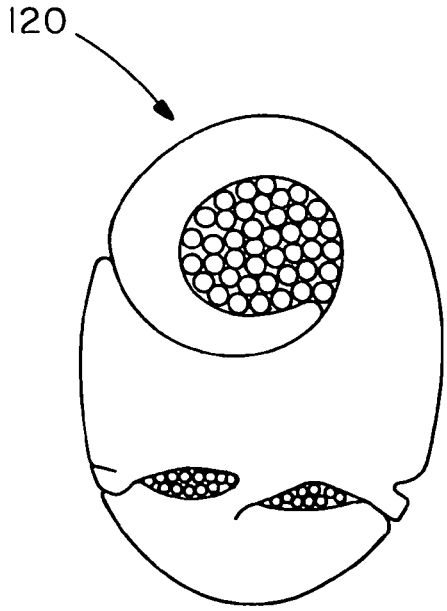
FIG. 12 is a front view of the compression connector of FIG. 7, after crimping two medium tap wires.

Retention tabs 46, 48 increase the overall compressibility of compression connector 20 because tap wire ports 42, 44 can accommodate different size tap wires 24, 26. As shown in FIG. 6, tap wire ports 42, 44 can accommodate large and small diameter tap wires 24, 26. Retention tab 46 minimizes the gap between first end wall 40 and first body portion 32 to improve the positioning and enhance the retention of tap wire 24 in tap wire port 42, before and during the crimping operation. Likewise, retention tab 48 minimizes the gap between first end wall 40 and first body portion 32 to improve the positioning and enhance the retention of tap wire 26 in tap wire port 44, before and during the crimping operation. Preferably, tap wire ports 42, 44 are teardrop-shaped. As best seen in FIG. 3, tap wire port 42 is larger than tap wire port 44. However, as shown in FIG. 8, tap wire ports 42, 44 may be the same size.

Figure 5:
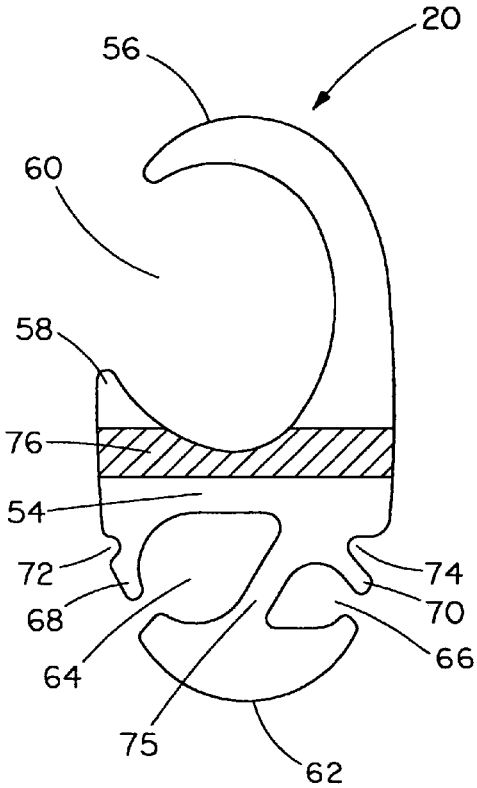
FIG. 5 is a cross-sectional view taken along lines 5—5 of FIG. 4.

Second section 30 is identical to first section 28. As best seen in FIG. 5, second section 30 includes a second body portion 54 having a hook 56 and a ramp 58 extending therefrom to form main wire port 60 in which main line wires 22 can be placed. Preferably, hook 56 is C-shaped. Second section 30 has a second end wall 62 connected to second body portion 54. Tap wire ports 64, 66 are adjacent second end wall 62, and retention tabs 68, 70 extend from second body portion 54 at an oblique angle. Groove 72 is positioned between retention tab 68 and ramp 58, and groove 74 is positioned between retention tab 70 and hook 56. Collapsible link 75 connects second body portion 54 and second end wall 62, and is positioned between tap wire ports 64, 66. As shown in FIGS. 1, 2 and 4, a central body portion 76 connects first body portion 32 and second body portion 54.

As best seen in FIG. 4, compression connector 20 includes two slots 78, 80 cut through compression connector 20. Slots 78, 80 provide space to loop a cable tie (not shown) to secure main line wires 22 and tap wires 24, 26 to compression connector 20 before crimping, as disclosed in co-pending U.S. Ser. No. 10/668,847, the disclosure of which is incorporated by reference in its entirety. Although FIGS. 1–6 show compression connector 20 having slots 78,80, it is likewise contemplated that compression connector 20 may not have any slots.

Figure 7:
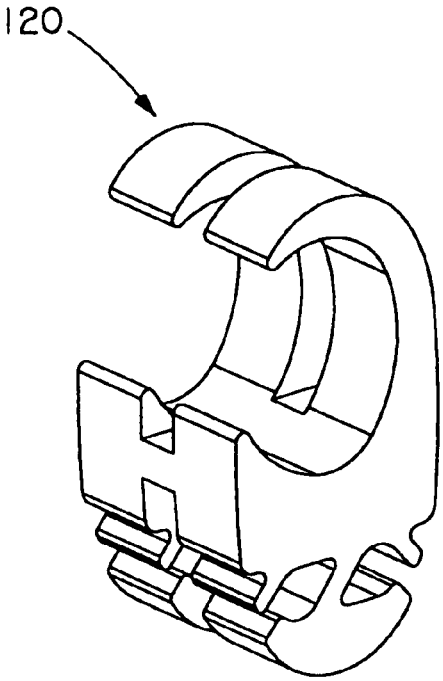
FIG. 7 is a front perspective view of a compression connector according to a second embodiment of the present invention.

A second embodiment of the present invention is illustrated in FIGS. 7–12. As shown in FIG. 7, a split multi-tap compression connector 120 is substantially the same as compression connector 20 illustrated in FIGS. 1–6, except the tap wire ports are substantially the same size. However, compression connector 120 functions similarly to compression connector 20 illustrated in FIGS. 1–6.

In operation, C-shaped compression connector 20 allows for partial hands-free installation because hooks 34, 56 can be hung around main line wires 22 while tap wire 24 is inserted into tap wire ports 42, 64, and tap wire 26 is inserted into tap wire ports 44, 66. Main wire port 38 and one of tap wire ports 42 or 44 must be utilized. The remaining tap wire port 42 or 44 may be utilized or left empty. Similarly, main wire port 60 and one of tap wire ports 64 or 66 must be utilized. The remaining tap wire port 64 or 66 may be utilized or left empty. Compression connector 20 is crimped with one single crimp over first section 28 and second section 30.

Compression connector 20 is crimped using a crimp tool (not shown), such as Panduit® CT-2940 crimp tool, fitted with a pair of crimp dies (not shown), such as Panduit® CD-940H-250 crimp dies. The outer radius of hooks 34, 56, first end wall 40 and second end wall 62 are smaller than the inner radius of the crimping dies and, thus, two die contact points are created. During crimping, as best seen in FIGS. 6 and 10–12, hooks 34, 56 encircle wires 22, resulting in a connection having improved electrical and mechanical performance.

Figure 13:
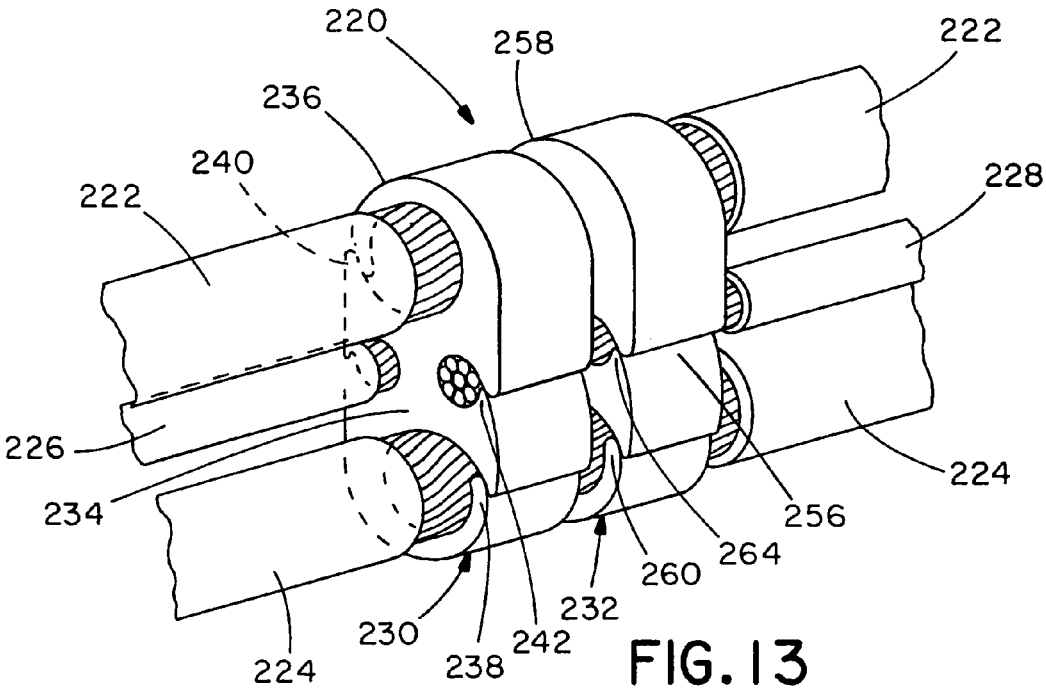
FIG. 13 is a perspective view of a compression connector according to a third embodiment of the present invention, shown secured around two main line wires after crimping two tap wires.

A third embodiment of the present invention is illustrated in FIGS. 13–19. FIG. 13 shows a split multi-tap compression connector 220 secured around main line wires 222, 224 and tap wires 226, 228, after crimping. Preferably, compression connector 220 is a one-piece member made of electrically conductive material, such as copper. However, it is likewise contemplated that compression connector 220 may be made of any suitable materials or elements that will withstand a crimping operation.

Figure 14:
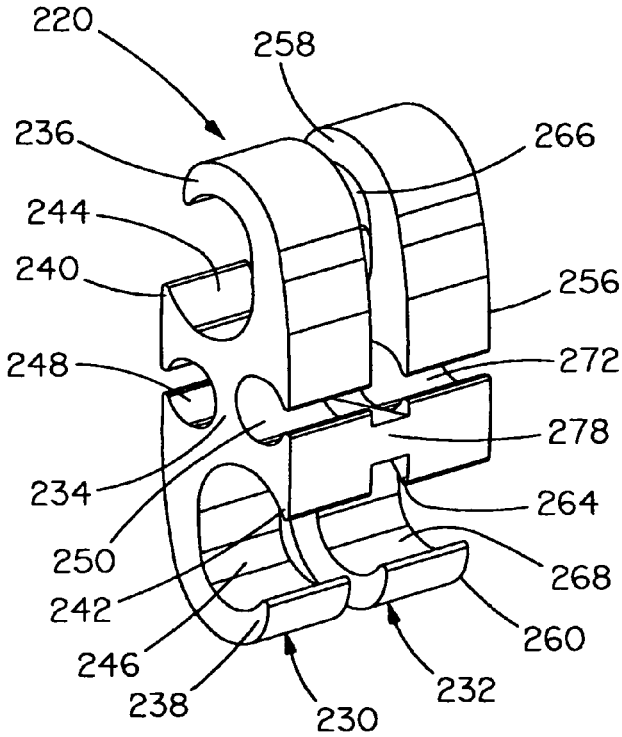
FIG. 14 is a perspective view of the compression connector of FIG. 13.
Figure 15:
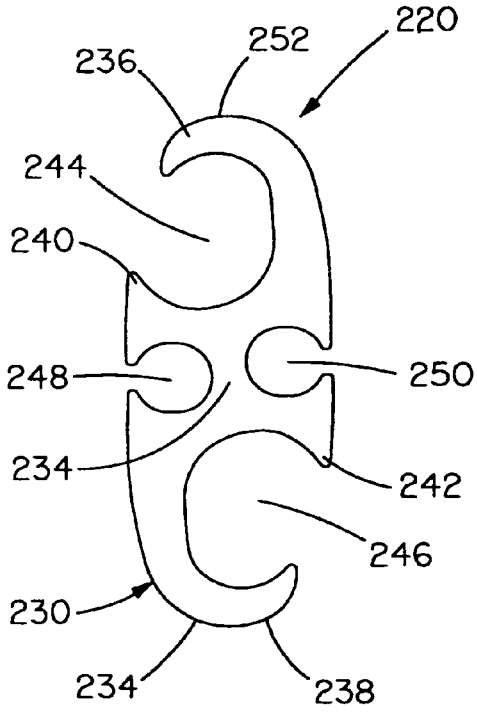
FIG. 15 is a front view of the compression connector of FIG. 13.
Figure 17:
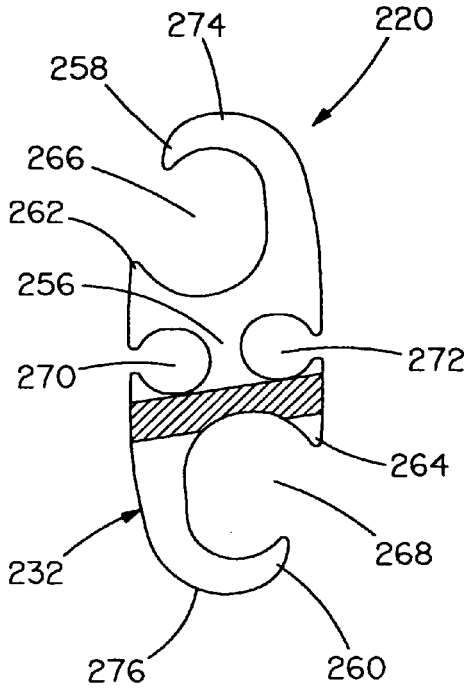
FIG. 17 is a cross-sectional view taken along lines 17—17 of FIG. 16.
Figure 18:
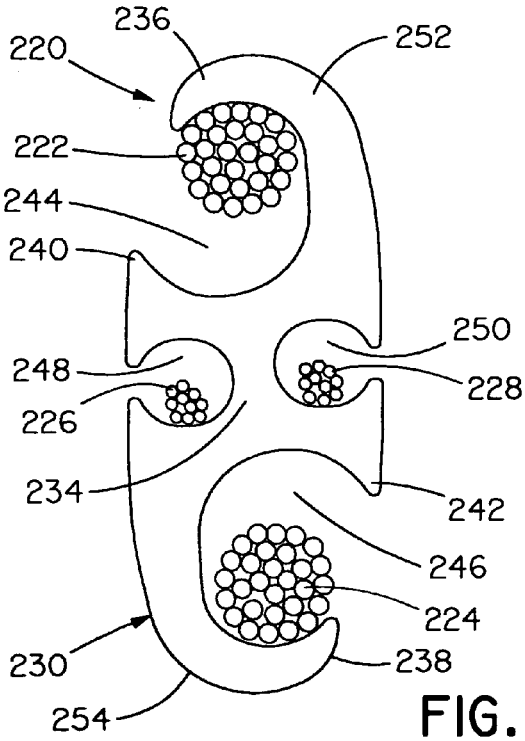
FIG. 18 is a front view of the compression connector of FIG. 13 prior to crimping.
Figure 19:
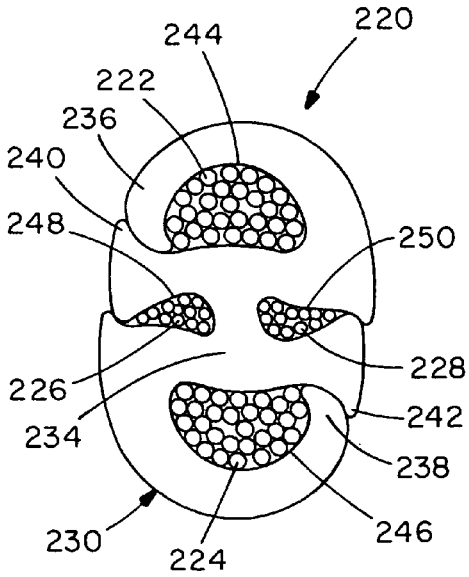
FIG. 19 is a front view of the compression connector of FIG. 13 after crimping.

As shown in FIG. 14, compression connector 220 has a first section 230 and a second section 232. First section 230 includes a first body portion 234 having hooks 236, 238 and ramps 240, 242 extending therefrom to form conductor receiving channels 244, 246 in which main line wires 222, 224 can be placed, as shown in FIG. 18. Preferably, hooks 236, 238 are C-shaped. As best seen in FIG. 18, S-shaped compression connector 220 allows for partial hands-free installation because hooks 236, 238 can be hung around main line wires 222, 224 while tap wires 226, 228 are inserted into side tap wire ports 248, 250. Non-coplanar side tap wire ports 248, 250 create an angled beam crumple zone, as shown in FIGS. 17–19. The outer radius of hooks 236, 238 is smaller than the inner radius of the crimping dies (not shown) and, thus, two die contact points 252, 254 are created. During the crimping operation, as best seen in FIG. 19, ramps 240, 242 wrap hooks 236, 238 around main line wires 222,224. As shown in FIG. 19, the angled beam crumple zone interlocks side tap wire ports 248, 250 to retain tap wires 226, 228 therein.

Figure 16:
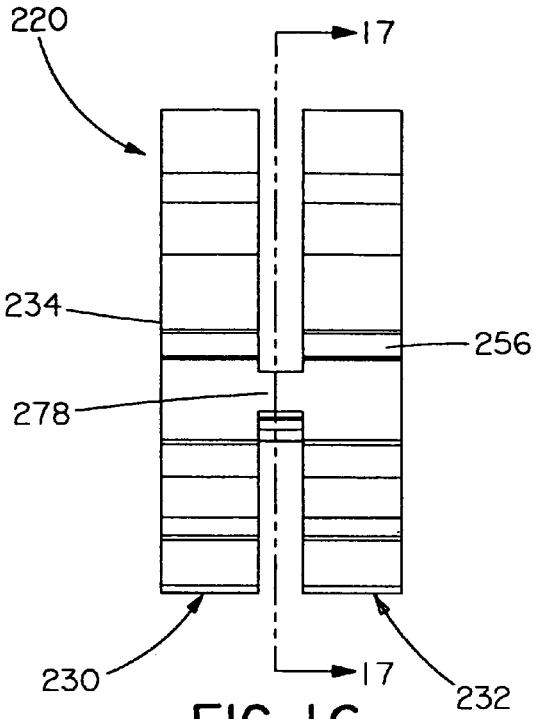
FIG. 16 is a right side view of the compression connector of FIG. 13.

Second section 232 is identical to first section 230. Second section 232 includes a second body portion 256 having hooks 258, 260 and ramps 262, 264 extending therefrom to form conductor receiving channels 266, 268 in which main line wires 222, 224 can be placed. Preferably, hooks 258, 260 are C-shaped. S-shaped compression connector 220 allows for partial hands-free installation because hooks 258, 260 can be hung around main line wires 222, 224 while tap wires 226, 228 are inserted into side tap wire ports 270, 272. The outer radius of hooks 258, 260 is smaller than the inner radius of the crimping dies and, thus, two die contact points 274, 276 are created. As shown in FIGS. 14 and 16, a central body portion 278 connects first body portion 234 and second body portion 256.

The disclosed invention provides a split multi-tap compression connector having improved retention of tap wires before and during the crimping operation. It should be noted that the above-described illustrated embodiments and preferred embodiments of the invention are not an exhaustive listing of the form such a compression connector in accordance with the invention might take; rather, they serve as exemplary and illustrative of embodiments of the invention as presently understood. By way of example, and without limitation, a compression connector having three or more tap wire ports is contemplated to be within the scope of the invention. Many other forms of the invention are believed to exist.

The invention claimed is:

1. A compression connector for securing wires therein, the compression connector comprising:

a body portion, wherein the body portion has a hook and a ramp extending therefrom to form a main wire port; and an end wall, the body portion further having a first tap wire port and a second tap wire port adjacent the end wall, wherein the body portion includes a first retention tab positioned adjacent the first tap wire port and a first groove positioned adjacent the first retention tab, with the first retention tab positioned between the first tan wire port and the first groove.

2. The compression connector of claim 1, wherein the hook is substantially C-shaped.

3. The compression connector of claim 1, wherein the first retention tab projects from the body portion at an acute angle relative to a horizontal axis extending between the first tap wire port and the second tap wire port.

4. The compression connector of claim 1, wherein the body portion further includes a second retention tab positioned adjacent the second tap wire port and a second groove positioned adjacent the second retention tab, with the second retention positioned between the second tap wire port and the second groove.

5. The compression connector of claim 4, wherein the second retention tab projects from the body portion at an acute angle relative to a horizontal axis extending between the first tap wire port and the second tap wire port.

6. A compression connector for securing wires therein, the compression connector comprising:

a body portion having a first substantially C-shaped hook and a first ramp extending therefrom to form a first main wire port, and a second substantially C-shaped hook and a second ramp extending therefrom to form a second main wire port, the body portion further having a first side tap wire port and a second side tap wire port opposite thereto, wherein the first side tap wire port is positioned between the first substantially C-shaped hook and the second ramp, and the second side tap wire port is positioned between the first ramp and the second substantially C-shaped hook.

* * * * *

UNITED STATES PATENT AND TRADEMARK OFFICE

CERTIFICATE OF CORRECTION

PATENT NO. : 7,026,552 B2
APPLICATION NO. : 11/005988
DATED : April 11, 2006
INVENTOR(S) : Robert L. Sokol et al.

It is certified that error appears in the above-identified patent and that said Letters Patent is hereby corrected as shown below:

Column 6, Line 1 "the first retention tab positioned between the first tan" should read "the first retention tab positioned between the first tap"

Signed and Sealed this

Eighteenth Day of July, 2006

JON W. DUDAS
*Director of the United States Patent and Trademark Office*